United States Patent [19]

Mochizuki

[11] 3,978,551

[45] Sept. 7, 1976

[54] DOOR CLOSER HINGE

[76] Inventor: Mitsuo Mochizuki, 3-10 Kamikosaka-cho, Higashi-Osaka, Japan

[22] Filed: June 5, 1975

[21] Appl. No.: 584,161

[30] Foreign Application Priority Data

Nov. 14, 1974 Japan ..... 49-138372

[52] U.S. Cl. ..... 16/189; 16/50; 16/72

[51] Int. Cl.[2] ..... E05F 1/1

[58] Field of Search ..... 16/188, 189, 49, 52, 16/50, 71, 72, 76, 82, 85, 78, 79, 80, 129, 132, 134

[56] References Cited

UNITED STATES PATENTS

| | | | |
|---|---|---|---|
| 2,591,476 | 4/1952 | Swanson | 16/191 X |
| 3,098,258 | 7/1963 | Ruiz | 16/50 |
| 3,212,126 | 10/1965 | Ruiz | 16/189 |
| 3,380,109 | 4/1968 | Ruiz | 16/50 |
| 3,512,212 | 5/1970 | Inoue et al. | 16/189 |
| 3,702,491 | 11/1972 | Pelletiere | 16/189 |
| 3,825,973 | 7/1974 | Gwozdz | 16/72 |
| 3,898,708 | 8/1975 | Gwozdz | 16/72 |

*Primary Examiner*—G. V. Larkin
*Attorney, Agent, or Firm*—Holman & Stern

[57] ABSTRACT

A door closer hinge including a coil spring providing torque which is mounted in the cylindrical axis of the hinge for automatically closing the door on which the hinge is mounted and including a ready adjustment for the coil spring pressure.

1 Claim, 3 Drawing Figures

DOOR CLOSER HINGE

FIELD OF THE INVENTION

This invention relates to a type of door closer hinge in which a torque-providing coil spring is fitted inside the cylindrical axis of the hinge securely so as to cause a door to close automatically by the action of the coil spring.

BACKGROUND OF THE INVENTION

This invention has for an object to provide such type of door closer hinge with an improved structure for securely mounting and fitting such coil spring in the cylindrical axis in such manner as to permit more efficient door-closing operation and simpler spring pressure adjustment as well as easier fabrication work.

According to the known type of door closer hinge, the internal ends of the upper and lower hinge pins are inserted into the upper and lower ends of the coil spring respectively to join the coil spring and the pins together to form then into one functionally united body which is inserted into the cylindrical axis of the hinge, whereupon a set pin is driven from one side of said cylindrical axis facing one of the hinge plates in order to fix the cylindrical axis to the hinge pin. Thereafter, the other hinge pin is turned to impart optimum torque to the coil spring, upon which another set pin is driven from the side of the cylindrical axis facing the other hinge plate.

Accordingly, the connection between the coil spring and the hinge pins was not secure and the torque imparted to the coil spring was fixed at a constant level and it was impossible to adjust the pressure of the spring once the hinge had been assembled or fabricated.

SUMMARY OF THE INVENTION

In order to overcome the above defect, the present invention provides an improved structure whereby the internal ends of the respective hinge pins are of bifurcated form to be engaged by the respective bent ends of the coil spring. Further, one pin is rotated to impart torque to the coil spring, while the other pin is fixed, and the periphery of the one pin has holes facing the surface of the cylindrical axis of the hinge which is provided with a plurality of alignable screw holes; upon completion of the operation to impart torque to the coil spring, a set screw is driven into one of the screw holes from the outside of the cylindrical axis to stop the coil spring and the hinge pins from rotating.

According to the present invention employing the above structure, the method of joining the coil spring with a pair of the hinge pins at its upper and lower ends becomes simpler and more effective and a door closer hinge is provided which is easy to assemble or fabricate and the structure of the hing permits its spring pressure to be easily and readily adjusted by loosening or tighening the adjustable torque-supplying pin.

Therefore, this invention provides an improved structure or means for mounting such coil spring securely and effectively in the cylindrical axis of the hinge so as to permit more efficient automatic door closing and at the same time a simpler adjustment of coil spring pressure and easier assemblying work.

The nature and other features of the invention will be more clearly understood from the following description made with reference to the attached drawings in which:

DETAILED DESCRIPTION OF A PREFERRED EMBODIMENT

Figure 2:
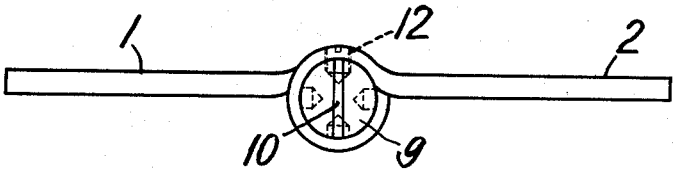
FIG. 2 is a top plan view of the embodiment shown in FIG. 1.
Figure 1:
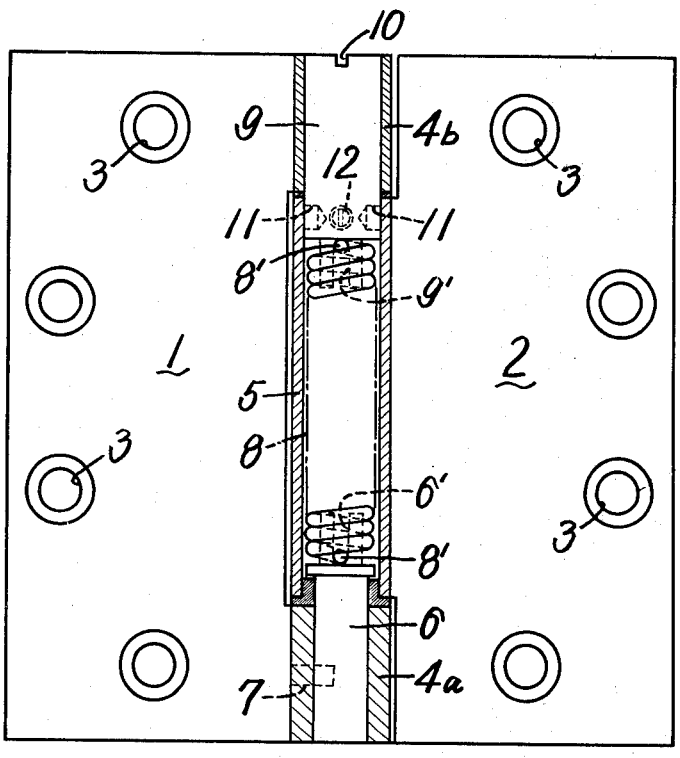
FIG. 1 is a front elevation, partly in section, showing an improved hinge assembly according to the invention.
Figure 3:
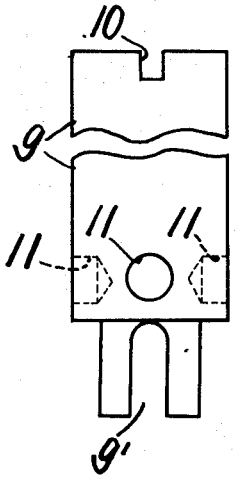
FIG. 3 is an enlarged front elevation, partly in section, of its hinge pin for imparting torque or a moment of rotation to its coil spring.

Referring to the drawing, a hinge assembly comprises a pair of hinge plates or leaves; one plate 1 can be fixed on to a wall, and the other plate 2 can be fixed to a door frame, as is conventional. Screw holes 3 extend through the plates 1 and 2 to accommodate driven fasteners for mounting the hinge between the door and frame. A lower cylindrical axis portion 4*a* is provided on the edge of hinge plate 1 in axial alignment with an upper cylindrical axis portion 4*b* also integral with the edge of the hinge plate 1.

A middle cylindrical axis portion 5 is formed on the edge of the hinge plate 2. With the cylindrical axis portions 4*a*, 5 and 4*b* in axial alignment, suitable washer elements can be provided therebetween when the hinge is assembled. A lower hinge pin 6 having an inner, terminal transverse groove 6' projects into the cylindrical axis portion 4*b* to receive the bent over, terminal end of coil spring 8. Projecting transversely through the cylindrical axis portion 4*b* is a set pin or screw 7 which anchors the pin and one terminal and 8' of the coil spring 8.

An upper hinge pin 2 is received in the cylindrical axis portion 4*b* and includes an inner transverse groove 9' engaging the other hook or bent end 8' of coil spring 8 which is axially disposed in the middle or central cylindrical axis portion 5 of hinge plate 2. The exposed end of hinge pin 9 includes a kerf or transverse groove 10 to receive a suitable tool such as a screw driver or the like for the purpose of adjusting the closing torque of the hinge assembly. The hinge pin 9 includes in the outer periphery thereof, in alignment with a transverse hole 12 in the cylindrical axis portion 5 of the hinge plate 2, a plurality of radially disposed screw holes 11, which will receive therethrough a suitable set screw driven through the hole 12 in the cylindrical axis portion 5 of plate 2 to be seated in any selected one of the screw holes 11 of the hinge pin 9.

ASSEMBLY AND OPERATION OF THE HINGE ASSEMBLY

The door closer hinge of this invention comprises a pair of the hinge plates 1 and 2 carrying thereon several screw holes, respectively, through which screws are driven into the wall or the door to fix the respective hinge plates to the wall and the door.

The upper and lower cylindrical axis portions 4*b* and 4*a*, respectively, can be formed by rolling around the upper and lower parts of the inner side edge of the hinge plate 1, and the middle cylindrical axis portion 5 formed, likewise by rolling around the middle side edge portion of the hinge plate 2.

These three cylindrical portions are then positioned coaxially to form one functional cylindrical axis portion or shaft, whereupon the lower pin 6 is inserted and pushed inward into the cylindrical shaft until it stops in the lower cylindrical axis 4*a*. The lower pin 6 is then rigidly fixed in position by means of the set pin 7 driven through the side of the lower cylindrical axis 4*a*.

The coil spring 8 is then inserted and pushed down into the cylindrical axis portion 4*b* from above and disposed in such manner that its bent-up, lower end portion 8' engages into the opening or groove 6' formed by the bifurcated internal end of the lower pin 6. Then the upper hinge pin 9 is inserted into the cylindrical axis portion 4*b* from above and so disposed as to have the groove or opening 9' engaged by the upper bent end 8' of the coil spring 8. The upper hinge pin 9 is then turned by applying a screw driver into the slit groove 10 of the pin 9 to impart torque or rotatory moment to the coil spring 8, whereupon the hinge pin 9 is firmly fixed to the upper cylindrical axis and the hinge plate 1 by means of a set screw driven through hole 12 driven into one of the screw holes 11 of the pin 9 through the side of the middle cylindrical axis 5.

With the above arrangement and construction, the connection between the coil spring 8 disposed in the cylindrical axes 4*a*, 4*b* and 5 as one functional cylindrical axis and the hinge pins 6 and 9 fixed to the hinge plates 1 and 2 respectively, is securely provided by the tight engagement of the bent ends 8' of the coil spring 8 within the openings or grooves 6' and 9' of the hinge pins 6 and 9, thereby rendering the fabrication of the hinge very easy and also ensuring firm connection between and among the coil spring, the hinge pins and the hinge plates.

With the present improved structure, by loosening the set screw in hole 12, the rotation of the upper hinge pin 9 and the coil spring becomes possible. This will permit the adjustment of torque of the coil spring 8 even after the hinge is assembled. When making this adjustment, a plurality of said screw holes 11 provided on the periphery of the hinge pin 9 make possible the minute adjustment of spring force (torque) within one complete turn of said pin 9.

Having thus described the nature and features of the invention, what I claim herein is as follows:

1. A hinge assembly comprising, in combination, a pair of hinge plates (1, 2), means (3) on said hinge plates for mounting the hinge assembly between a closure and closure-opening, one of said hinge plates including integral, with one side edge thereof two axially spaced cylindrical, axis portions (4*a*, 4*b*), the other of said hinges plates including integral at one edge thereof a central, cylindrical axis portion (5) in coaxial alignment with the axially space cylindrical portions of said one plate and forming therewith an axial sleeve extending the height of the adjacent edges of the plates on which the cylindrical axis portions are formed; a first hinge pin (6) projecting into and contained within the cylindrical axis portion (4*a*) of said one hinge plate having a terminal end and within one end of said cylindrical axis portion of the other plate, said first hinge pin having a transverse bifurcation (6') at the terminal end; lock means (7) extending through the cylindrical axis portion (4*a*) of the one plate and extending into and anchoring the pin (6) against rotation therein; a coil spring (8) having one transverse end (8') seated in the bifurcation (6') of said pin, said coil spring extending substantially the length of the central cylindrical axis portion of the other hinge plate; a second hinge pin (9) disposed completely within the other cylindrical axis portion (4*b*) and having a bifurcated terminal end (9') projecting into the central cylindrical axis portion (5) of the other of said hinge plates, said second hinge pin having a plurality of radially opening, circumferentially spaced recess portion (11), said second hinge pin having a transverse kerf (10) exposed at the end of the cylindrical, axis portion in which said second hinge pin is hidden, said cylindrical axis portion of said other plate in which the coil spring is disposed having a transverse opening (12) alignable with at least one of the radially, opening recesses in said second hinge pin; and fastener means removably secured in the transverse opening and one of the radially opening recesses (11) for retaining the hinge assembly in assembled relationship and permitting the second hinge pin to be rotated at said kerf to impose residual, closing-torque in the hinge and maintain it while the hinge is assembled and while on a closure and closure-opening.

* * * * *